United States Patent [19]

Yon

[11] 3,931,725

[45] Jan. 13, 1976

[54] MOBILE MACHINE FOR PRODUCING METAL SIDING

[75] Inventor: Robert E. Yon, Middletown, Pa.

[73] Assignee: Specialty Design & Mfg. Co., Reading, Pa.

[22] Filed: Apr. 16, 1975

[21] Appl. No.: 568,696

[52] U.S. Cl. ..... 72/181
[51] Int. Cl.[2] ..... B21D 5/08
[58] Field of Search ..... 72/181, 179, 178

[56] References Cited

UNITED STATES PATENTS

| | | | |
|---|---|---|---|
| 3,051,214 | 8/1962 | Rutlen | 72/181 |
| 3,447,351 | 6/1969 | Werntz | 72/181 |
| 3,791,185 | 2/1974 | Knudson | 72/181 |

*Primary Examiner*—Milton S. Mehr
*Attorney, Agent, or Firm*—Synnestvedt & Lechner

[57] ABSTRACT

A portable machine for the production of siding of alternative cross sectional configurations from metallic stock, the siding of both configurations being of equal width and including butts adjacent their lower edges and marginal portions shaped for interfitting engagement with marginal portions of adjacent siding strips when the strips are laid. The strips of one configuration have only the lower butt and the strips of the other configuration have an additional intermediate butt. The machine includes a series of spaced pairs of upper and lower shafts, said shafts supporting opposed rollers having shaping elements for gradually shaping the lower butt and the marginal portions of the stock, and certain of said shafts additionally supporting mounting means intermediate said spaced pairs of upper and lower rolls for the support of readily attachable and detachable shaping elements for forming said intermediate butt when desired. Inasmuch as for the siding strips having the intermediate butt the stock must be of increased width, the rollers carrying the elements for shaping one of the marginal portions of the stock are mounted for ready longitudinal adjustment on their shafts for conversion of the machine from the production of the single-butt siding strips to the production of the double-butt siding strips and vice versa.

8 Claims, 16 Drawing Figures

FIG. 3
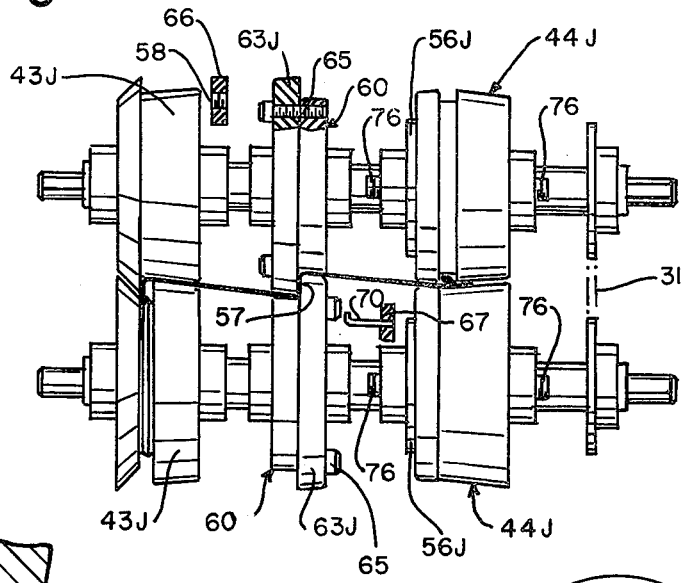
FIG. 5
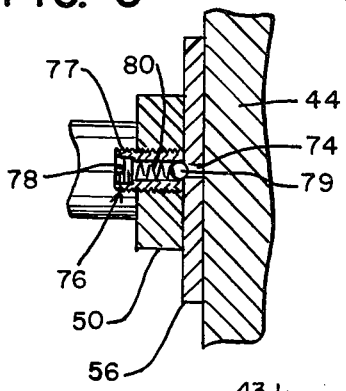
FIG. 4
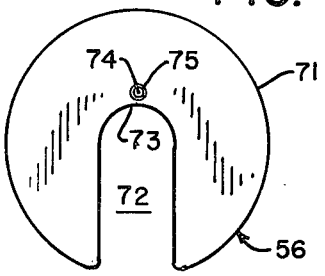
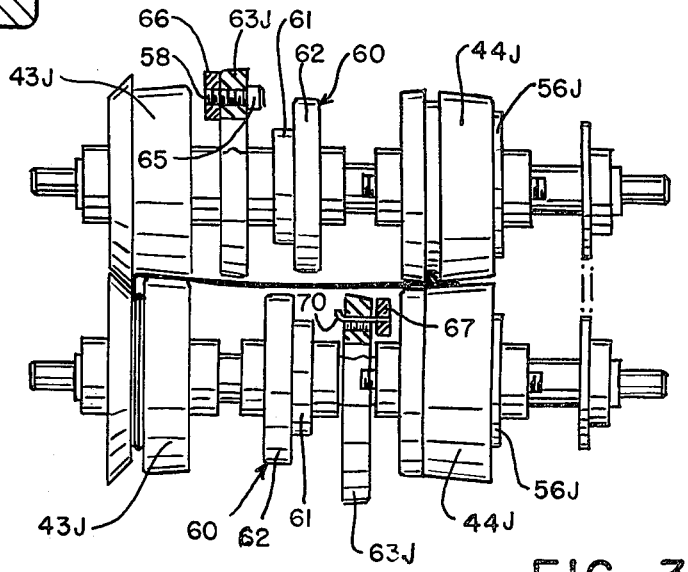
FIG. 3A

MOBILE MACHINE FOR PRODUCING METAL SIDING

BACKGROUND OF THE INVENTION

1. Field of the Invention

The present invention relates to portable machines for employment at the job site for converting metal strip material, such as aluminum strip stock, into simulated wooding siding. The simulated siding, which may in some cases be employed over correspondingly-shaped wooden siding and in other cases over wall surfaces of other types, is typified by bevel 8-inch siding having a single butt and double 4-inch bevel siding additionally having an intermediate butt. In both types, the siding further includes marginal interlocking means for employment in the assembly or laying of the siding strips on a wall surface.

2. Description of the Prior Art

Portable machines for the production of siding simulating wooden siding from metal strip stock have heretofore been developed, the machines in some instances being also convertible to produce siding of either the single-butt or multiple-butt type as desired for a particular job. Reference is made in this connection to patent to Knudson U.S. Pat. No. 3,791,185, issued Feb. 12, 1974. The machine disclosed, which is of the portable type similarly as Applicant's machine, employs ten sets of opposed strip-shaping rolls, the first seven sets of said ten sets being of a form to shape the marginal edges of the strip to define means for interlocking engagement with adjacent strips when the siding is applied and also to provide a lower butt. The remaining three sets of rolls are of a character to form the intermediate butt when that is desired.

In order to convert the machine from the production of one type of siding to the other, the lower rolls of the final three sets of rolls are carried by a support structure which is movable between positions in which the lower rolls are in strip-shaping relationship with the upper rolls of the three sets and positions lowered therefrom. As will be understood when the lower rolls of the three sets are in strip-shaping relationship with the upper rolls of the sets, the intermediate butt will be formed and when the lower rolls are moved to inactive positions, the stip will pass therebetween without further shaping operations being performed on it and a siding of the single-butt type will result.

Another prior patent of interest in this connection is Beymer U.S. Pat. No. 3,788,115, issued Jan. 29, 1974. The patent also discloses a machine for forming siding from metal strip material, the siding being of either the single or double-butt type. The machine of the patent has a first series of opposed shaping rolls for forming the interlocking marginal portions of the siding and the lower butt. The machine additionally includes an extension supporting three sets of shaping rolls for forming the intermediate butt, when that is desired, the extension being swingable between operative and inoperative positions. As a result, when the extension is in its operative position, double-butt sliding is produced, and when in its inoperative position, single-butt siding is produced.

In both of the above prior patented constructions, the width or span of the siding strip will necessarily be reduced when the double-butt type of siding is being made as the additional butt, the butt normally being ½ inch in width, will reduce the total width of the siding strip by approximately that amount. Thus, if the machine of either of the above patents is set up to produce single-butt siding of the standard exposed width of 8 inches, when converted to provide the double-butt siding the exposed width will be only approximately 7 ½ inches or 3 ¾ inches for each simulated siding strip which would normally be 4 inches in width. A further disadvantage of the patented machines is that the rolls which are employed to form the interlocking portions on the marginal edges of the strip material for both the single-butt and double-butt sidings are limited to the first group of shaping rollers whereby a more desirable gradual shaping of the metal of the strip margins, which would result if all of the sets of rolls were involved, cannot be obtained.

SUMMARY OF THE INVENTION

The principal object of the instant invention is the provision of a portable machine for the shaping of metallic strip stock into siding strips or the like of either of alternate transverse cross sectional configurations with the widths of the strips adapted for exposure being at least substantially the same in both instances.

Another object of the invention is the provision of a machine attaining the foregoing object in which the change-over of the machine for converting it from the production of one type of siding strip to the other may be made with a minimum of down time.

A further object of the invention is the provision of a machine for the production of simulated siding strips having marginal strip interlocking means and having a single or both a single and intermediate butt, as desired, the machine including a plurality of sets or pairs of opposed strip-shaping means to form the lower butt and said marginal strip interlocking means and certain of said pairs of opposed strip-shaping means including readily attachable and detachable means for forming the intermediate butt when that is desired.

In the preferred embodiment of the instant invention, the machine includes an elongated frame structure carrying bearings for rotatably supporting the shafts of a plurality, preferably ten, pairs of opposed strip-shaping means. The machine also includes frame members projecting upwardly from the main frame structure for the support of a coil of the strip material to be shaped, the coil being positioned adjacent the strip entry end of the machine (hereinafter referred to as the "forward end"). Additional frame members at the forward end support bearings for the shaft of a conventional strip-bending roller for removing the coil set from the strip stock. The strip stock material is adapted to be drawn from the coil thereof and to be passed partially around the bending roll and thereafter to enter the machine between spaced guide means, at least one of which, namely the guide means for the edge of the strip stock which will define the upper edge of the shaped strips, is adjustable relatively to the other to accomodate different widths of the strip material.

The strip-shaping means comprises the ten pairs or sets of horizontal shafts carrying rollers for the conversion of a flat strip of material into a strip having a longitudinally-extending butt in one marginal portion (hereinafter referred to as the "lower marginal portion") and means for forming interlocking connections with similar strips when the strips are laid, in both the lower and the opposite or upper marginal portions. Certain of the pairs or sets of shafts are additionally provided with hub means intermediate the edge-shaping rollers, the hub means being adapted to support readily attachable and detachable rim members for the formation of the intermediate butt, when that is desired. The frame elements of the machine additionally include longitudinally-extending members having means for the support of the rim members in inoperative positions when the latter are detached from their hubs.

The rollers for forming the marginal configuration of the strip opposite to that in which the butt is formed (hereinafter referred to as the "upper marginal configuration") are mounted for adjustment on their shafts between first positions in which they are all spaced a given distance from the rollers which form the lower butt and second positions in which such spacing is adjusted in varying amounts.

In the operation of the machine for the production of simulated single-butt siding, the rollers for forming the upper marginal configuration of the siding strip are adjusted to their first position on their shafts, the rim members of the intermediate rolls are removed from their hubs and supported in their inoperative positions and the adjustable guide means at the forward end of the machine is adjusted to accomodate the width of the strip material required. The sets of rolls are then driven and the strip stock fed into the machine for gradual shaping by the shaping rolls to the required cross sectional configuration. For the conversion of the machine to produce siding including an intermediate butt, the rollers for forming the upper marginal configuration are adjusted to their second positions, the rim members of the intermediate rolls are removed from their inoperative positions and replaced on their hubs and the adjustable guide means is adjusted for the accommodation of the greater width of material required.

DESCRIPTION OF THE DRAWINGS

FIG. 3 is a sectional view on an enlarged scale taken on the line 3—3 of FIG. 1 and looking in the direction indicated by the arrows, but with framing elements omitted, the view illustrating the position of certain of the parts in the production of siding of one cross sectional configuration;

FIG. 3A is a view corresponding to FIG. 3, but illustrating the position of said certain of the parts for the production of siding of a second cross sectional configuration;

FIG. 4 is a plan view of a spacer element as employed for the adjustment of the positions of certain of the shaping elements in the conversion of the machine from the production of siding of one cross sectional configuration to the other;

FIG. 5 is a detail view with parts in section and on an enlarged scale, illustrating the manner of employment of a spacer of FIG. 4 in a selected location and the means for removably retaining it in such location.

Figure 2:
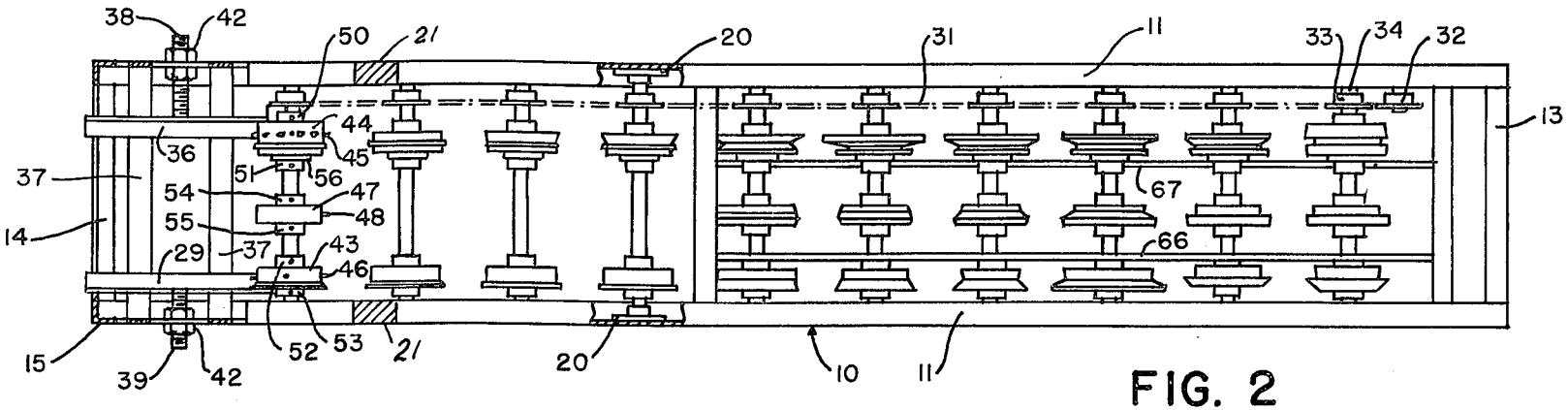
FIG. 2 is a sectional view taken on the line 2—2 of FIG. 1 and looking in the direction indicated by the arrows and with parts broken away.
Figure 1:
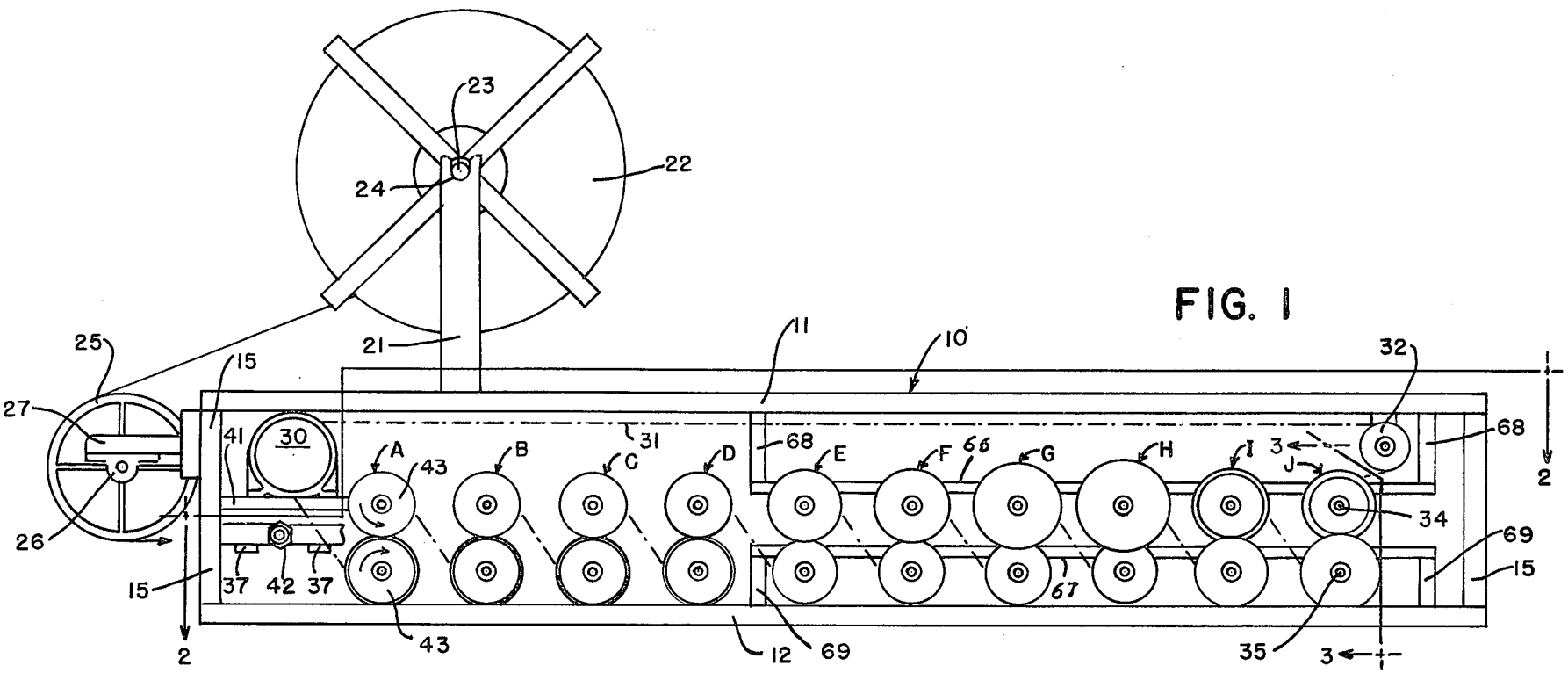
FIG. 1 is a side elevational view of the machine of the instant invention with various framing and supporting elements omitted for clearness of illustration.

Referring now to the drawings and, more particularly to FIGS. 1 and 2, the machine in which the features of the present invention are incorporated includes a generally rectangular frame structure 10 including spaced upper rails 11 and spaced lower rails 12, the upper rails being connected by a plurality of cross rails 13, one of said cross rails being shown in FIG. 2, and the lower rails being connected by a plurality of cross rails 14, one of said rails also being shown in FIG. 2. The upper and lower rails are supported in vertically spaced relationship by members 15 at the four corners of the frame structure. As shown, the rails and vertical members are preferably angle irons and are secured together as by welding. In addition, top, bottom and side cover plates (not shown) may be employed, if desired, the cover plates being secured to the frame structure to form a housing for the machine.

The frame structure additionally includes vertically-extending members 20 connecting the upper and lower rails on each side of the machine, the members 20 carrying bearings for the ends of the shafts of a plurality of sets, namely sets or pairs A–J (see FIG. 1), of opposed shaping elements for converting the strip stock into either one of two desired cross sectional configurations. As is conventional, the bearings for the shafts of either the upper or lower shaping elements of each set may be made adjustable relatively to the bearings for the other shaping elements of the set by any suitable means (not shown) to permit the selection of the spacing between the shaping elements of each pair to accomodate strip material of different thicknesses.

Posts or uprights 21 project upwardly from the frame structure adjacent the forward end of the machine for the support of a reel 22 which in turn supports a coil of the sheet metal strip material which is to be converted into the simulated siding strips. The reel 22 is mounted on a shaft 23, the ends of which are received in bearing notches 74 of the uprights 21. A conventional bending roller 25 is supported outwardly of the forward end of the machine in bearings 26 carried by outwardly-extending frame elements 27, the bending roll being adapted to remove the coil set normally found in the metallic strip material upon its being unwound from the coil.

An electric motor 30 for driving the shafts of the several sets of shaping elements is mounted on a base 41 carried by the frame structure in an elevated position at the forward end of the machine, as illustrated in FIG. 1. The motor is employed to drive the shafts of the shaping elements by means of a sprocket and chain combination including an endless chain 31 leading from a sprocket (not shown) carried by the motor shaft (not shown) to a sprocket 32 supported for rotation adjacent the rear end of the machine and thence in a counterclockwise direction partially around a sprocket 33 carried by the shaft 34 of the upper one of the set J of shaping elements for producing a final cross sectional configuration to the strip, thence in a clockwise direction partially around a sprocket (not shown) carried by the shaft 35 supporting the lower shaping element of said set and thence similarly partially around sprockets corresponding to sprockets 33 carried by the shafts of the upper and lower shaping elements of the remaining sets I to A inclusive, only the sprockets on the shafts of the upper shaping elements being shown.

Motor 30, when energized, drives the shafts for the upper and lower shaping elements in counterclockwise and clockwise directions respectively as indicated by the arrows (see FIG. 1). Energization of the motor is under the control of a switch (not shown) suitably mounted on the frame structure adjacent the rear end of the machine.

The machine as described to this point is, for the most part, generally of conventional type. An additional feature which is also of basically conventional type is the provision of means for guiding the strip material as it leaves bending roller 25 and enters the machine. The guiding means, as disclosed, includes (see FIG. 2) spaced angle members 29 and 36 with their vertical flanges projecting upwardly and with their horizontal flanges resting on support bars 37, the bars spanning the width of the machine and having their ends secured as by welding to the frame structure. The spaced angle members 36 and 29 are affixed as by welding to the ends of threaded elements 38 and 39 respectively, the elements penetrating openings in frame elements of the machine. The angle members are adjusted to the desired positions and maintained therein by pairs of nuts 42, one of each pair serving as a lock nut. The ability to adjust the spacing of angle member 36 relatively to angle member 29 is of particular importance in the machine of the instant invention, as will later become apparent.

Figure 6A:
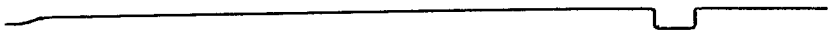
FIGS. 6A–6J inclusive are views showing the cross sectional configurations of the strip stock following its passage between successive pairs of shaping elements to produce siding elements of one cross sectional configuration.
Figure 6B:
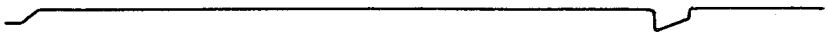
Figure 6C:
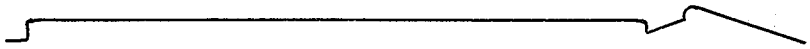
Figure 6D:
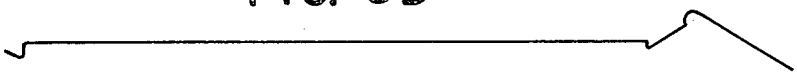
Figure 6E:
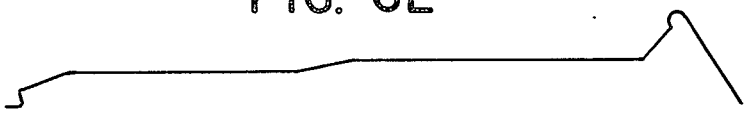
Figure 6F:
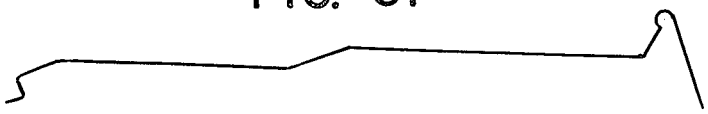
Figure 6G:
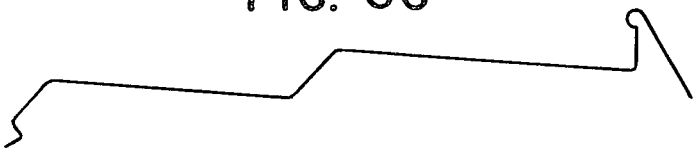
Figure 6H:
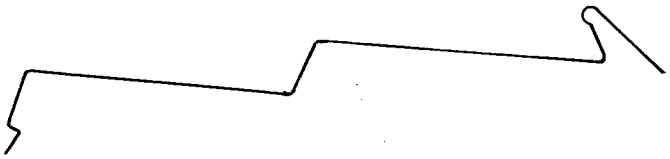
Figure 6I:
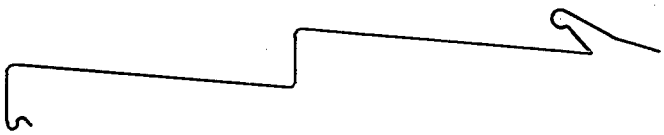

Referring particularly to FIGS. 1, 2 and 6A–J inclusive, the shaping elements supported by the successive pairs of opposed shafts will now be described. It will be understood that FIGS. 1 and 2 disclose the machine set up to produce the siding strips with the intermediate butt as well as a lower butt. The changes required to convert the machine to the manufacture of single-butt siding will be explained hereinafter. The shafts of the first set A carry cooperating rollers 43 contoured to impart the initial shape as shown in FIG. 6A to the marginal portion of the strip which will include the lower butt and a pair of co-operating rollers 44, only one of the rollers being shown in FIG. 2, which are contoured to impart the initial shape to the marginal portions of the strip defining the upper marginal portion of the siding strip. For convenience, it will be assumed that one is observing the machine from the forward or sheet stock entry end thereof, and such pairs will be referred to respectively as the right- and left-hand pairs. As is conventional, one of the rollers, suitably the upper roller, of pair 44 includes a series of punches 45 and the lower roll of the pair includes a groove (not shown) to receive the punches, the punches being employed for forming nail holes in the upper marginal portion of the siding strip. The upper roll of the right-hand pair similarly has one or more punches 46 and the lower roll of the pair has a groove (not shown) to receive the punch or punches, the punches being positioned to form spaced breather or drain holes in the lower butt of the siding strip. The shafts of the set also support a pair of intermediate rolls 47 of flat edge contour whereby they will not affect the shape of the strip material, the upper roll 47 of the pair, the only one shown, supporting one or more punches 48 and the lower roll of the pair being grooved to receive the punch or punches to form breather or drain holes in the intermediate butt when that is being formed. However, each punch 48 is supported for ready removability, as by having a threaded end received in a correspondingly threaded socket in the roll, when the machine is to be converted from the production of a double-butt siding to the production of single-butt siding.

The rollers of each pair 43, 44 and 47 are secured in any suitable way in predetermined positions longitudinally of their shafts and for rotation with their shafts. Preferably, the positioning means consists of collars 50 and 51 for rollers 44, the collars being secured in predetermined positions on their shafts by set screws received in threaded openings in the collars and adapted for securing contact with the shafts. Similar sets of collars 52–53 and 54–55 secured to the shafts by set screws are employed for the pairs of rolls 43 and 47 respectively. For ensuring rotation of rollers with their shafts, each shaft is provided with a keyway extending longitudinally and suitably for the full length thereof, corresponding keyways in the rollers and collars supported by the shaft and keys received within the keyways. Such use of keyways and keys for causing rotation of rollers with their shafts being well known, the keyways and keys have not been shown in the drawings. The positioning of the lefthand pair of rollers 44 longitudinally of their shafts is also determined by spacer element 56 inserted between each collar 51 and its associated roller when the double-butt siding is being produced. The purpose for which the spacers are employed and specific features of the spacers will later be pointed out.

The right- and left-hand roller pairs of the remaining sets of shaping means B to J inclusive, the rollers and associated elements where shown of the particular configuration required for a particular set as in FIGS. 3 and 3A, being assigned the same reference characters as employed for such rollers and elements of set A but with the set-designating letter added, are contoured to form the successive shapes in the marginal portions of the strip material as illustrated in FIGS. 6B–J inclusive. However, the punching dies 45 and 46 are, of course, omitted. The manner in which the pairs of rollers are mounted on their respective shafts is suitably the same as that employed for the rollers of set A.

The collars on the upper shafts 34 and the lower shafts 35 of the successive sets corresponding to collars 51 are in general alignment longitudinally of the machine. Similarly, the collars of each of the sets on the upper shafts 34 and the lower shafts 35 corresponding to collar 52 of set A are in general alignment, and the collars corresponding to collar 53 of set A are in general alignment, longitudinally of the machine, any variation from exact alignment being due to minor variations in the widths and positioning of the rolls. Each shaft carries a spacer element corresponding, except as noted below, to spacer element 56 of set A and similarly located. The spacer elements, however, are of varying thicknesses on certain of the shafts for purposes hereinafter to be pointed out. As a result, the collars corresponding to collar 50 of set A will, in certain instances, be varyingly spaced from collars corresponding to collar 51 in accordance with the variance in the thickness of the spacers as well as variations in the widths of the rollers.

Figure 6J:
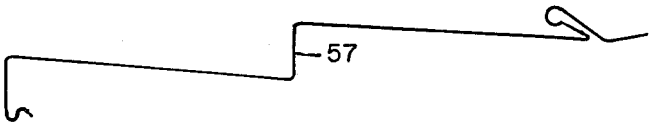

Referring now particularly to FIGS. 1, 3 and 3A, the pair of shafts for each of the shaping sets E to J inclusive additionally support means for forming the intermediate butt when the double-butt siding is to be produced. For this purpose, they are each provided with hub elements 60 (see particularly FIG. 3A) positioned intermediate the rolls for forming the marginal configurations of the strip material. Hub elements 60 are maintained in their desired positions by collars corresponding to collars 54 and 55 of set A, the collars being secured in fixed positions on their shafts by set screws (not shown) and being additionally keyed to their respective shafts for rotation therewith in the manner previously described for the collars 50–53. Also, the hub elements are in alignment longitudinally of the macine. The hub elements each include a hub 61 and an outwardly-extending annular flange portion 62, the hubs and annular flanges of the upper and lower hub elements being in relatively reversed positions. The hub elements are adapted to support annular rim members 63, designated 63J in FIGS. 3 and 3A, the rim members each having a central opening of a diameter substantially equal to but slightly greater than the diameter of hub 61. For the production of the double-butt siding the rim members are positioned on the hubs and secured in such positions by threaded studs 65 penetrating a plurality of bores in the rim members and threaded into associated threaded bores in the annular flange portions 62. The rim members and the annular flange portions of the successive sets are dimensioned and contoured to produce the successive intermediate shaping of the metal strip as disclosed in FIGS. 6E– J, the final shaping operation producing the completed intermediate butt 57 as shown in FIGS. 3 and 6J.

The machine additionally includes means for supporting the rim elements 63 in inoperative positions out of contact with operating elements and with the strip material, but within the confines of the machine frame structure, when the single-butt siding is to be produced. The means for this purpose includes upper and lower bars 66 and 67 respectively, the bars extending longitudinally of the length of the machine occupied by sets E to J of the shaping elements. Bar 66 is positioned above the shafts carrying the upper shaping elements and to the left, as viewed in FIGS. 3 and 3A, of the shaping elements for the intermediate butt, bar 67 is positioned between the upper and lower shafts and to the right of the shaping elements for the intermediate butt, as viewed in FIGS. 3 and 3A. The bars are supported in the above-stated positions by upwardly-extending vertical elements 68 and downwardlyextending vertical elements 69 respectively, the ends of the vertical elements remote from the bars being secured as be welding to frame members of the machine. The upper bar 66 is provided with tapped openings 58, there being one such opening in vertical alignment with each of the upper shafts of the sets E to J of the shaping elements. The lower support bar 67 is in the preferred embodiment provided with a series of hooks 70, one being positioned in vertical alignment with each of the lower shafts of the sets E to J of the shaping elements, the hooks being of a character to be received within one of the threaded bores of the rim member adapted to be mounted on the hub element of its associated shaft. For the shifting of the rim members from operative to inoperative positions, the studs 65 securing the upper rim members to their hub elements are removed and each rim member is positioned with one of its stud-receiving bores in alignment with a bore in support bar 66. Stud 65 or a similar stud is then inserted in the bore of the rim member, but in a reversed position, and threaded into the bore of support bar 66. To shift the rim members of the lower roller sets from operative to inoperative positions, the studs 65 are similarly removed and each rim member is positioned on its hook 70, the latter projecting through one of the bores normally receiving the stud 65. The use of the stud as the securing means for the rim members of the upper shaping means in their inoperative positions rather than employing a hook constitutes a safety feature. As will be understood, if hooks of the type of hook 70 were to be employed for the support of the upper rim members in their inactive positions during the production of single-butt siding, any excessive vibration of the machine might well cause one or more of the rim members to fall off its associated hook and damage the siding being produced. On the other hand, if any of the rim members of the lower shaping means should be jarred off its hook 70, it will cause no damage to the strip material. The hooks are preferred because of the ease and time saving involved in the mounting of the rim members thereon as compared to the employment of the studs. However, the stud-securing means, similarly as used for rim members of the upper shaping means, may be employed in place of the hooks if desired.

Referring now particularly to FIGS. 3, 3A, 4 and 5, the construction and operation of the spacers 56 mounted on the shafts for each of the pairs of shaping rollers 44 will be described. As is apparent, when the double-butt siding of FIG. 3 is to be produced, the strip material employed must be of a greater width than the strip material employed for the production of the single-butt siding shown in FIG. 3A, the additional width being approximately equivalent to the depth of the intermediate butt. Also, particularly with respect to the sets of strip-shaping elements which include the means for forming the intermediate butt, the sets of rollers 44 forming the marginal portion of the strip material opposite to that in which the lower butt is formed must be successively shifted until such rollers of the final set J are in the position or substantially the position they would be in for the formation of the single-butt siding.

However, in actual practice it has been determined that due to spring-back characteristics of the metal employed, even the pair of rolls 44 of set J, which determine the final configuration of the upper marginal portion of the siding strip, must be spaced a somewhat greater distance from the pair of rolls 43 forming the lower marginal portion than is the case when single-butt siding such as shown in FIG. 3A is being formed. Also, the spring-back characteristics of the metal require various of the spacers to be of a thickness other than that which would normally be considered correct. Specifically, in order to produce a double 4-inch siding, it has been determined that the thicknesses in inches of the spacers for the successive shaping sets should be as set forth below.

| Set A | Sets B-E | Set F | Set G | Set H | Set I | Set J |
|---|---|---|---|---|---|---|
| 0.340 | 0.450 | 0.365 | 0.345 | 0.205 | 0.190 | 0.100 |

As will be understood, because of the necessarily relatively small scale of the drawings, no attempt has been made to show the variations in thickness of the successive spacers in FIG. 2, nor are the spacers shown of the proper thicknesses relatively to associated parts in FIGS. 3 and 3A.

Referring now particularly to FIGS. 4 and 5, the construction of the spacers and their manner of association with and removal from the shafts of the shaping roller sets will be described. As illustrated in FIG. 4, each spacer 56 is of approximately horseshoe configuration and is defined by a semicircular outer edge 71 and a slot 72 extending inwardly therefrom and terminating in a semicircular end portion 73 for contact with the shaft on which the spacer is to be positioned. The diameter of the semicircular end portion and the width of the slot are such as to readily but snugly receive the shafts of the shaping roll sets. The spacer is provided with a bore 74 having preferably a somewhat tapered or expanded mouth 75.

Each spacer is mounted on its associated shaft by positioning the slot in line with the shaft and then moving it in the direction of the shaft until the latter is contacted by end portion 73. The mounting of the spacer may be performed with the spacer in a horizontal, vertical or any intermediate position, and after mounting, may be rotated to a position to bring bore 74 into alignment with a spacer-securing means 76 carried by each of the collars 50 and 51 for the pairs of rollers 44A–J. For convenience of illustration, the spacers have been shown in horizontal positions in FIGS. 3 and 3A.

Referring now to FIG. 5, which is a detail view on an enlarged scale with parts in section and other parts broken away, the spacer 56 is illustrated positioned on the shaft for the upper roller 44 between the inner surface of the roller and collar 50. The preferred embodiment of the spacer-securing means 76 is what is termed a "spring plunger" such as manufactured by the Vlier Engineering Corp. of Burbank, California. The spring plunger includes a threaded tubular element 77 for reception in a correspondingly threaded opening in the collar and a threaded plug 78 received in a correspondingly threaded outer rim portion of the tubular member. It also includes a ball 79 of a diameter to partially penetrate bore 74 and a compression spring 80. The spring 80 is so selected that the force it exerts against ball 79 is sufficient to maintain the ball in the somewhat expanded mouth 75 of the bore notwithstanding the centrifugal forces created by the rotation of the shaft and any vibration or jarring to which the shaft is normally subjected during operation. On the other hand, when the spacer is to be removed, such removal may be readily obtained by forcing it off the shaft with a sliding movement of the spacer, the spring yielding to permit the ball to adjust its position as required for this operation. Similarly, the spacer is installed on the shaft by moving the roller into spaced relationship with collar 50 as shown in FIG. 5 and then sliding the spacer into the space between the collar and the roller until ball 79 overlies bore 70 at which time the ball will snap into the mouth 75 of the bore.

In the operation of the machine for, for example, producing double four-inch siding with lower and intermediate butts, each ½ inch in width, from strip stock, suitably aluminum strip, of a width of 11 ½ inches, a coil of the strip stock is mounted on reel 22, angle member 36 of the guiding means is adjusted relatively to angle member 29 to accomodate the strip of the width being employed between their vertical flanges, and the spacers 56 for the upper and lower shafts of each of the several sets of shaping elements are mounted on their shafts in the positions shown in FIG. 2, namely between the collars 51 and the rollers 44. In addition, the rim members 63 of the shaping means for forming the intermediate butt in sets E to J inclusive are removed from their respective support bars 66 and 67 and installed on their associated hubs 61 and studs 65 or other studs inserted to maintain them in their operating positions. In addition, punch 48 is screwed into its socket in roll 47. Strip stock is then manually drawn from the roll thereof and passed around bending roll 25 and through the guide means. Motor 30 is then started and the end of the strip is positioned in the nip between the first set of shaping means A. The strip material is thereafter drawn through the machine by the rolls. It will be understood that suitable guiding and supporting means (not shown) for the strip for its initial introduction between the successive pairs of strip-shaping sets may preferably be employed. Alternatively, the strip may be manually guided and supported. Upon continued operation of the machine, the strip material is converted from its original flat condition through the several cross sectional contours disclosed in FIGS. 6A to 6I inclusive, and then to the final cross sectional contour of FIG. 6J.

For the production of siding strips of the single-butt type having an exposure width of 8 inches, strip stock of a width of 10 ½ inches is preferably employed. To convert the machine from the production of the double-butt siding to the production of such single-butt siding, angle member 36 of the guide means is adjusted inwardly to accomodate the width of the stock between its vertical flange and the vertical flange of angle member 29. The spacers 56 are snapped off the shafts supporting them and rollers 44 are slid inwardly on the shafts into contact with collars 51. The spacers are then replaced on the shafts, but between rollers 44 and the outer collars 50. Also, the rim elements 63 of the shaping means for the intermediate butt at sets E to J inclusive are removed from their hubs and supported in inoperative positions by the bars 66 and 67. In addition, the punch 48 is removed from roll 47. A roll of the strip stock is then positioned on reel 22 and fed into the machine as before. In operation, the sets of shaping elements will result in the same gradual formation of the shapes of the marginal portions of the sheet from that of FIG. 6A to that of FIG. 6J as obtained in the production of the siding with the intermediate butt. However, the intermediate butt will not, of course, be formed and the siding will have the cross sectional configuration as disclosed in FIG. 3A.

It will be understood that the machine as described above may include additional features often employed in portable machines for the production of siding strips. For example, roller means for squaring the lower butt of the strip, particularly when the siding with both the lower and intermediate butts is being produced, may be supported for movement between operative and inoperative positions adjacent to but to the rear of the final set J of the shaping elements. In addition, the machine may be provided with a preferably attachable and detachable saw or a guillotine device for severing the completed siding strip material into the mitered lengths required.

I claim:

1. A machine for forming a strip of metallic stock into a siding strip of either a first or a second cross sectional configuration, with the siding strips of both configurations having first and second marginal portions, with the first marginal portion shaped to define a butt, and both marginal portions shaped to define siding strip interconnecting means, and said siding strip of said second configuration additionally having an intermediate butt, said machine comprising a succession of pairs of opposed strip-shaping means, shafts supporting said strip-shaping means for rotation therewith, and means for rotating said shafts, said pairs of opposed strip-shaping means each comprising first and second spaced-apart roller means having shaping elements for forming said above-defined shapes of said first and second marginal portions, and certain of said succession of pairs of opposed strip-shaping means each including additional roller means having readily attachable and detachable shaping elements for forming, when attached, said intermediate butt.

2. A machine as defined in claim 1 wherein there is means for adjusting the relative spacing of said first and second spaced-apart roller means in the conversion of said machine from the production of siding elements of one of said first and second cross sectional configurations to the other.

3. A machine as defined in claim 2 wherein said means for adjusting the relative spacing of said first and second spaced-apart roller means comprises means mounting said roller means having shaping means for forming one of said first or second marginal portions for longitudinal adjustment relatively to the other on the shafts supporting said spaced-apart roller means.

4. A machine as defined in claim 3 wherein said means for mounting said roller means for longitudinal adjustment on their shafts comprises spaced collar means secured to said shafts on opposite sides of said roller means for determing the limits of adjustment of said roller means on their shafts, spacer means adapted for insertion into selected positions between either side of said roller means and said collar means, and means for releasably securing said spacer means in said selected positions.

5. A machine as defined in claim 1 wherein there is means within said machine for supporting said readily attachable and detachable shaping elements in inoperative positions when detached.

6. A machine as defined in claim 1 wherein said additional roller means comprise hub portions and said shaping elements comprise rim members for securement to and removal from said hub portions.

7. A machine as defined in claim 6 wherein there is means for supporting said rim members in inoperative positions when detached from said hub portions.

8. A machine as defined in claim 7 wherein said means for supporting said rim members in inoperative positions comprises rails extending longitudinally of said machine and there is means for supporting said rim members from said rails.

* * * * *